US006713733B2

(12) United States Patent
Kochman et al.

(10) Patent No.: US 6,713,733 B2
(45) Date of Patent: Mar. 30, 2004

(54) TEXTILE HEATER WITH CONTINUOUS TEMPERATURE SENSING AND HOT SPOT DETECTION

(75) Inventors: Eric Kochman, Highland Park, IL (US); Dmitry Kochman, Vernon Hills, IL (US)

(73) Assignee: Thermosoft International Corporation, Buffalo Grove, IL (US)

( * ) Notice: Subject to any disclaimer, the term of this patent is extended or adjusted under 35 U.S.C. 154(b) by 0 days.

(21) Appl. No.: 10/422,834

(22) Filed: Apr. 25, 2003

(65) Prior Publication Data

US 2003/0189037 A1 Oct. 9, 2003

Related U.S. Application Data

(63) Continuation-in-part of application No. 10/075,273, filed on Feb. 15, 2002, now Pat. No. 6,563,094, which is a continuation-in-part of application No. 09/309,917, filed on May 11, 1999, now Pat. No. 6,452,138.

(51) Int. Cl.[7] ..... H05B 3/34

(52) U.S. Cl. ..... 219/549; 219/517; 219/529; 219/494

(58) Field of Search ..... 219/200–212, 219/520, 527–529, 538, 539, 542, 545, 548, 549, 490, 494, 507, 509, 510, 517; 174/107; 337/159, 293, 295

(56) References Cited

U.S. PATENT DOCUMENTS

| | | | |
|---|---|---|---|
| 1,703,005 | A | 2/1929 | Hewitt |
| 2,496,279 | A | 2/1950 | Ely et al. |
| 2,820,085 | A | 1/1958 | Crowley |
| 3,349,359 | A | 10/1967 | Morey |
| 3,385,959 | A | 5/1968 | Ames et al. |
| 3,627,981 | A | 12/1971 | Kuhn |
| 3,657,516 | A | 4/1972 | Fujihara |
| 3,774,299 | A | 11/1973 | Sato et al. |
| 3,808,403 | A | 4/1974 | Kanaya et al. |
| 3,825,870 | A | 7/1974 | Ono et al. |
| 3,935,422 | A | 1/1976 | Barnes et al. |
| 4,051,094 | A | 9/1977 | Reuter et al. |
| 4,149,066 | A | 4/1979 | Niibe |

(List continued on next page.)

FOREIGN PATENT DOCUMENTS

| | | | |
|---|---|---|---|
| DE | 21 48 191 | A | 4/1973 |
| DE | 32 33 904 | A | 3/1984 |
| DE | 32 43 061 | A | 5/1984 |
| FR | 2 323 289 | A | 4/1977 |
| FR | 2 590 433 | | 5/1987 |
| GB | 1 243 898 | A | 8/1971 |
| JP | 07 006867 | | 1/1995 |
| WO | WO 95 33358 | A | 12/1995 |
| WO | WO 98 01009 | A | 1/1998 |
| WO | WO 98 09478 | A | 3/1998 |

*Primary Examiner*—Tu Ba Hoang
(74) *Attorney, Agent, or Firm*—Liniak, Berenato & White

(57) ABSTRACT

A soft and flexible heater utilizes electrically conductive threads or fibers as heating media. The conductive fibers are encapsulated by negative temperature coefficient (NTC) material, forming temperature sensing heating cables. One or more heating cables can be formed into heaters of various configurations including tapes, sleeves or sheets providing simultaneous heat radiation and local overheat protection. Such heaters may be connected in different combinations, in parallel or in series. The heater may contain continuous positive temperature coefficient (PTC) temperature sensors to precisely control the temperature in the heater. Such temperature sensors can be made of electrically conductive fibers, metal wires or fiber optical filaments. When required by the heater design, the electrically conductive threads/fibers may have a polymer base, which acts as a Thermal-Cut-Off (TCO) at predetermined temperatures. Electrically conductive fibers comprised of such polymer base can melt between 110° C. and 350° C. thereby terminating electrical continuity in the heater.

12 Claims, 4 Drawing Sheets

U.S. PATENT DOCUMENTS

| | | | | |
|---|---|---|---|---|
| 4,250,397 | A | | 2/1981 | Gray |
| 4,309,596 | A | | 1/1982 | Crowley |
| 4,523,086 | A | | 6/1985 | Eilentropp |
| 4,538,054 | A | | 8/1985 | de la Bretoniere |
| 4,607,154 | A | | 8/1986 | Mills |
| 4,713,531 | A | | 12/1987 | Fennekels et al. |
| 4,742,212 | A | | 5/1988 | Ishii et al. |
| 4,764,665 | A | | 8/1988 | Orban et al. |
| 4,792,662 | A | | 12/1988 | Kitagaki et al. |
| 4,825,049 | A | | 4/1989 | Rickborn |
| 4,969,840 | A | | 11/1990 | Li et al. |
| 4,983,814 | A | | 1/1991 | Ohgushi et al. |
| 5,023,433 | A | | 6/1991 | Gordon |
| 5,068,518 | A | | 11/1991 | Yasuda |
| 5,298,722 | A | | 3/1994 | Tanaka |
| 5,412,181 | A | | 5/1995 | Giamati |
| 5,643,480 | A | | 7/1997 | Gustavsson et al. |
| 5,801,914 | A | | 9/1998 | Thrash |
| 5,824,996 | A | | 10/1998 | Kochman et al. |
| 6,031,214 | A | | 2/2000 | Bost et al. |
| 6,078,025 | A | | 6/2000 | Yeung |
| 6,229,123 | B1 | * | 5/2001 | Kochman et al. ..... 219/549 |
| 6,310,332 | B1 | | 10/2001 | Gerrard |
| 6,452,138 | B1 | * | 9/2002 | Kochman et al. ..... 219/549 |
| 6,563,094 | B2 | * | 5/2003 | Kochman et al. ..... 219/549 |

* cited by examiner

TEXTILE HEATER WITH CONTINUOUS TEMPERATURE SENSING AND HOT SPOT DETECTION

This application is a Continuation-in-part of application Ser. No. 10/075,273 filed on Feb. 15, 2002, now U.S. Pat. No. 6,563,094 which is a Continuation-in-part of U.S. patent application Ser. No. 09/309,917 filed May 11, 1999, now U.S. Pat. No. 6,452,138.

BACKGROUND OF INVENTION

1. Field of Invention

This invention relates to soft and flexible electrical heaters, and particularly to heating elements, which have soft and strong metal or carbon containing electrically conductive textile threads/fibers.

2. Description of the Prior Art

Heating elements have extremely wide applications in consumer household products and in, construction, industrial application, etc. Their physical characteristics, such as thickness, shape, size, strength, flexibility and other characteristics affect their usability in various applications. Numerous types of thin and flexible heating elements have been proposed. For example, a heating element proposed by Ohgushi (U.S. Pat. No. 4,983,814) is based on a proprietary electro conductive fibrous heating element produced by coating an electrically nonconductive core fiber with electro conductive polyurethane resin containing the carbonatious particles dispersed therein. Ohgushi's manufacturing process appears to be complex; it utilizes solvents, cyanides and other toxic substances. The resulting heating element has a temperature limit of 100° C. and results in a pliable but not soft heating element. In addition, polyurethane, used in Ohgushi's invention, when heated to high temperature, will decompose, releasing very toxic substances, such as products of isocyanides. As a consequence, such heating element must be hermetically sealed in order to prevent human exposure to toxic off gassing. Ohgushi claims temperature self-limiting quality for his invention; however "activation" of this feature results in the destruction of the heater. He proposes the use of the low melting point non-conductive polymer core for his conductive fabric-heating element, which should melt prior to melting of the conductive layer, which uses the polyurethane binder with the melting point of 100° C. Thus, the heating element of Ohgushi's invention operates as a Thermal Cut Off (TCO) unit, having low temperature of self-destruction, which limits its application.

U.S. Pat. No. 5,861,610 to John Weiss describes a heating wire, which is formed with a first conductor for heat generation and a second conductor for sensing. The first and second conductors are wound separately as coaxial spirals with an insulation material electrically isolating the two conductors. The two spirals are counter-wound with respect to one another to insure that the second turns cross, albeit on separate planes, several times per inch. The described construction results in a temperature sensing system, which can detect only the average change of resistance in the sensing wire due to elevation of the temperature in the heated product. Therefore, in the event of overheating of a very small surface area of the blanket or pad (for example, several square inches), the sensor may fail to detect a minor change of electrical resistance (due to operating resistance tolerance) along the heating element. In addition, such heating cable does not have inherent Thermal-Cut-Off (TCO) capabilities in the event of malfunction of the controller. The absence of the localized hot spot detection and the use of breakable metal wires make this heating element vulnerable to failure and not sufficiently safe for foldable products, such as heating pads and heating blankets.

Thrash (U.S. Pat. No. 5,801,914) describes an electrical safety circuit that utilizes two parallel conductors connected to a positive temperature coefficient material (PTC) and sacrificial fuse filament. Such sacrificial filament is connected to a separate switching circuit, which terminates electrical continuity of the PTC heating element in the event of fire hazard. The main disadvantages of this design are that (a) the switching circuit deactivates power only after arcing/fire has already started and burned the sensor fiber filament, thus producing a fire hazard to a heating product; and (b) the addition of a sensing sacrificial filament enlarges the overall thickness of conventional PTC cables, which already feature stiffness and bulkiness.

Gerrard (U.S. Pat. No. 6,310,332) describes an elongated heating element for an electric blanket comprising a first conductor means to provide heat for the blanket and extending the length of the element, a second conductor means extending the length of the element, and a meltdown layer between the first and second conductor means which is selected, designed and constructed or otherwise formed so as to display a negative temperature coefficient (NTC), and including electronic controller set to detect a change in the resistance of the meltdown layer to provide a means of changing the power supply to the first conductor means (providing heat to the blanket), to prevent destruction of the melt down layer. The element further includes a meltdown detection circuit for detecting meltdown of the meltdown layer and for terminating power to the first conductor means in the event that the control means fails and the meltdown layer heats up to a predetermined degree. The disadvantage of this construction is that the final safety of the blanket relies on a complex NTC/meltdown detection system located in the controller. In the event the controller fails, or significantly delays detection of NTC layer meltdown, then a severe scorching of the heating product, or fire hazard, can occur.

In the event a blanket user bypasses the controller by energizing the blanket directly from the power outlet, the heating element will not provide any overheat or fire hazard protection because the Gerrard's heating element does not have inherent Thermal-Cut-Off (TCO) properties. The heating element utilizes winding of breakable metal wires, which makes construction thicker and more obtrusive for flexible heating products, such as heating pads and blankets.

Another disadvantage of the Gerrard's invention is that its control system utilizes a half-wave power cycle for heating and another half-wave power cycle for meltdown stroke detection in order to provide proper heating output and meltdown protection. Therefore, the heating wire has to be twice thicker than comparable systems utilizing a full-wave power output. This feature becomes especially challenging for 120V and other lower voltage heating systems, compared to traditional European 240V systems. An increase in the thickness of heating wire leads to: (a) increase in the cost of heating conductor; (b) increase in the overall size of the heating element and (b) possibility of breaking the heating wires due to their reduced flexibility.

The present invention seeks to overcome the drawbacks of the prior art and describes the fabrication of a heater comprising metal fibers, metal wires, metal coated, carbon containing or carbon coated threads/fibers, which is economical to manufacture, does not pose environmental hazards, results in a soft, flexible, strong, thin, and light heating element core, suitable for even small and complex assemblies, such as hand wear. Significant advantages of the proposed invention are that it (a) provides for fabrication of heaters of various shapes and sizes with predetermined electrical characteristics; (b) allows for a durable heater, resistant to kinks and abrasion, and (c) with its electro-physical properties it is almost unaffected by abuses such as pressure, severe folding, small perforations, punctures and crushing. A preferred embodiment of the invention consists of utilizing electrically conductive textile threads/fibers having an inherent Thermal Cut Off (TCO) function to prevent overheating and/or fire hazard. The preferred system utilizes a NTC sensing layer for hot spot detection, which does not require having low-temperature meltdown characteristics. Because the proposed conductive fibers are extremely flexible, the coaxial winding process is not required in the heating element manufacturing, which makes the heaters extremely thin, light and durable. The heaters described in this invention may also comprise a continuous temperature PTC sensor to precisely control heating power output in the heating product. The control system may utilize the most economical full-wave power to vary heating output and to provide local hot spot detection.

SUMMARY OF THE INVENTION

The first objective of the invention is to provide a significantly safe and reliable heater which can function properly after it has been subjected to severe folding, kinks, small perforations, punctures or crushing, thereby solving problems associated with conventional flexible metal wire heaters. In order to achieve the first objective, the heater of the present invention may comprise (a) electrically conductive threads/fibers and (b) multi-layer insulation of the conductive threads/fibers. The conductive threads/fibers may be comprised of carbon, metal fibers, and/or textile threads coated with one or combination of the following materials: metal, carbon and/or electrically conductive ink. The proposed heater may also comprise metal wires and their alloys. The electrically conductive textile threads/fibers may possess the following characteristics: (i) high strength; (ii) high strength-to-weight ratio; (iii) softness and flexibility. The heating element core described in this invention is comprised of electrically conductive tapes, sleeves/tubes, sheets or cables, which radiate a controlled heat over the entire heating core surface. The multi-layer insulation of the electrically conductive threads/fibers provides increased dielectric properties, preventing or minimizing current leakage in the event of abuse of the heater. The multi-layer insulation may be applied in the form of encapsulation (through extrusion process) or lamination with insulating synthetic materials, having similar or different thermal characteristics.

A second objective of the invention is to provide maximum flexibility and softness of the heating element. In order to achieve the second objective, the electric heating element of the invention may contain thin (0.01 to 3.0 mm, but preferably within the range of 0.05–1.0 mm) conductive threads/fibers, which are woven, non-woven, knitted or stranded into continuous or electrically connected tapes, sleeves/tubes, cables or sheets. Another preferable configuration may consist of extruding soft insulating material, such as, but not limited to polyvinyl chloride (PVC), polyurethane, nylon, polypropylene, temperature resistant rubber, cross-linked PVC or polyethylene around a multitude of electrically conductive textile thread/fibers.

A third objective of the invention is to provide for the uniform distribution of heat, without overheating and hot spots, thereby preventing excessive insulation and improving energy efficiency. In order to achieve this objective: (a) conductive threads in the heating elements may be separated by non-conductive fibers/yarns or insulating polymers, (b) one side of the heating element may include a metallic foil or a metallized material to provide uniform heat distribution and heat reflection. It is also preferable that the soft heating elements of the invention are made without thick cushioning insulation, which slows down the heat delivery to the surface of the heating unit.

A forth objective of the invention is to provide a high level of temperature control. In order to achieve the forth objective, at least one metal wire and/or electrically conductive textile fiber runs throughout the heater, acting as a continuous temperature sensor. It is connected to an electronic power control regulator, which establishes a maximum power output limit for the heating product. It is preferable that such temperature sensor possess high positive temperature coefficient properties.

A fifth objective of the invention is to provide a high level of safety, minimizing the possibility of fire hazard. In order to achieve the fifth objective: (a) multiple thin heating cables may be reinforced by strong and flame retardant threads/fibers, (b) a negative temperature coefficient (NTC) sensor layer is applied to detect local overheating through the entire length of the heating element, (C) Positive Temperature Coefficient (PTC) or NTC continuous sensors may be applied to provide precise temperature control of the heating system, and (D) the conductive heating media of the heating cables may comprise metal or carbon containing electrically conductive textile threads/fibers with a polymer base having a melting temperature from 110° C. to 350° C. The melting of the conductive threads/fibers causes termination of the electrical continuity in the heating system. Thus, the proposed heating cables can operate as an inherent melting fuse or TCO (Thermal-Cut-Off) device.

The present invention comprises a heating element containing soft, strong and light electrically conductive textile threads/fibers acting as a heating means. The heating element is highly resistant to punctures, cuts, small perforations, severe folding and crushing. It can be manufactured in various shapes and sizes, such as cables, strips fabrics or sleeves, and it can be designed for a wide range of parameters, including but not limited to input voltage, temperature, power density, type of current (AC or DC) and method of electrical connection (parallel or in series). The heating element may contain non-conductive fibers/yarns or insulating polymers which are combined with electrically conductive individually insulated metal or carbon containing threads/fibers by knitting, weaving into or, laminating between layers of woven or non-woven fabric or sheeting, forming tapes, sleeves/tubes or sheets.

Selected areas of the heating element may contain electrically conductive textile fibers or wires to provide continuous PTC temperature sensing and/or may act as regular electrical conductors (collectively: "heat detection means") to provide an electrical signal to the electronic controller. The NTC sensing layer is located between such heat detection means and the heating electrically conductive textile threads/fibers ("heating means"). The electrically conductive textile fibers also act as a continuous thermal fuse, terminating continuity in the heater at the temperatures 110° C.–350° C. as dictated by the heating element design.

The heating element may be shaped by folding, turning, molding, weaving, stitching, fusing, and/or laminating or by any other appropriate assembling technique to obtain the predetermined configuration of the heater. The electrical terminals, such as connector pins, crimps or electrodes may be attached to the ends of said heating element. The electrically conductive textile fibers may be electrically connected in parallel or in series.

DETAILED DESCRIPTION OF THE INVENTION

Figure 1A:
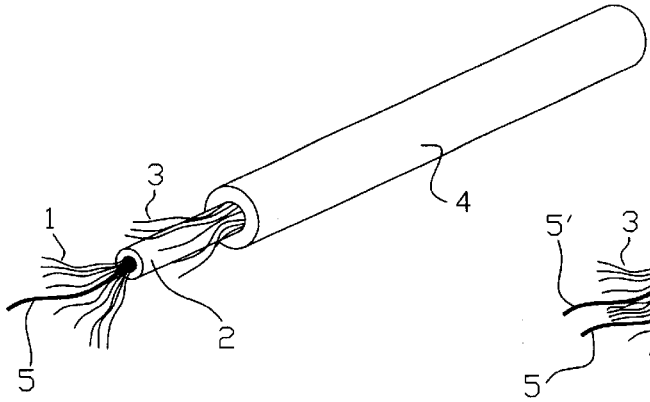
FIG. 1A shows an isometric view of a heating cable consisting of electrically conductive textile fibers encapsulated by one layer of NTC sensing material, heat detection wires or electrically conductive fibers and outer cable insulation.

The invention consists of a soft heating element core made by interconnecting conductive metal and/or carbon containing threads/fibers with nonconductive yarns/fibers or polymers. Said core may be assembled as individual cables, tapes, sleeves/tubes or sheets. The heating element core may contain, electrically conducting metal fibers, metal coated and/or carbon containing threads, which may be combined with non-conducting yarns/fibers or polymers in various proportions and/or weaving, or knitting or non-woven patterns in order to augment the heating element core electrical resistance.

The term "heater" described in this invention shall mean any electrical heat radiating device comprising at least one of the following parts: (a) round or flat cable, (b) tape, (c) sheet, or (d) sleeve.

For convenience of explanation of the invention, the term "thread" shall mean at least one of the following threads or yarns: stitching thread, knitting thread, weaving thread or yarn.

The term "metal fibers" shall mean metal fibers/filaments, having a denier size of synthetic textile fibers. The diameter of each metal fiber is smaller than the lowest commercially available metal wire gauge. An example of metal fibers may be Bekinox® stainless steel continuous filament/fiber yarn, manufactured by Bekaert Corporation.

The term "metal wire" shall mean at least one continuous metal strand having a diameter greater than the individual metal fiber/filament described above. The metal wire may contain at least one or a combination of the following metals: copper, iron, chromium, nickel, silver, tin and gold. The metal wire may be in the form of a thin wire wound around a nonconductive fiber core. The combination of metals may be in the form of plating one metal over another or mixing different metals in predetermined proportions forming alloys.

The term "carbon containing fibers" or "carbon containing threads" described in this invention shall mean textile fibers, comprising at least one of the following materials: (a) carbon/graphite threads/fibers, (b) textile fibers/threads, which contain carbon or graphite particles inside the polymer fibers, or (c) synthetic polymer or ceramic fibers/threads coated or impregnated with carbon or carbon/graphite containing material.

The term "conductive textile" described in this invention shall mean soft electrically conductive textile material comprising electrically conductive threads/fibers with or without inclusion of nonconductive materials, such as, laminated, stranded, knitted, woven or non-woven fibers.

The term "electrically conductive textile fibers" described in this invention shall mean textile threads/fibers or filaments, comprising electrically conductive materials. Electrically conductive textile threads or fibers may be made completely of electrically conductive fibers, such as metal fibers or carbon/graphite fibers. Electrically conductive textile fibers may be comprised of nonconductive fibers or particles combined with electrically conductive fibers, particles or layers of electrically conductive coating.

The term "metal coated threads" described in this invention shall mean electrically conductive textile threads or fibers, coated by at least one of the following highly electrically conductive metals: silver, gold, copper, tin, nickel, zinc, palladium, their alloys or multi-layer combination. Such coating may be applied on carbon/graphite threads, extruded polymer filaments, synthetic threads/fibers, fiberglass or ceramic threads/fibers by sputtering, electroplating, electroless deposition or by any other appropriate metal coating or impregnation technique.

The term "melting fuse" or "fuse" described in this invention shall mean electrically conductive textile fibers which melt at the temperatures between 110° C. and 350° C. Such melting results in termination of the electrical continuity in said electrically conductive textile fibers.

The term "nonconductive means" described in this invention shall mean any electrically nonconductive material, which can provide electrical insulation between electrically conductive textile fibers. Such nonconductive means may be comprised of weaving yarns, knitted threads/fibers, extruded or jacketed insulating polymer, knitted, woven or non-woven synthetic fabric or inorganic fibers/textile.

The term "heating means" described in this invention shall mean electrically conductive material, which provides heat radiation upon application of sufficient voltage to the heater. As an example, the electrically conductive textile fibers or metal wires may be heating means.

The term "heating cable" described in this invention shall mean electrically conductive textile fibers, as a heating means, encapsulated by at least one insulating layer of non-conductive means.

The term "electronic controller" described in this invention shall mean solid state power control device, which provides sensing and/or variation of heat radiation in the heater. Usually, the electronic controller is located between the electrical power source and the heating means. However, it also may be designed as a wireless remote controller with the receiver/regulator located between the electrical power source and the heater.

The term "NTC sensing means" or "NTC sensing layer" described in this invention shall mean a layer of polymer material or fabric possessing negative temperature coefficient (NTC) characteristics. The NTC capability of plastic or fabric may result from the use or design of a single material, or alternatively, the respective quality may be obtained by coating, cross linking, doping, or mixing of several materials to achieve the required NTC performance. As an example, polymers, comprising polyethylene, polyvinyl chloride (PVC), thermoplastic rubber or polyamide may have NTC sensing properties.

For purposes of the invention, the NTC sensing means exhibits NTC characteristics, preferably in such a way that with gradual increase of the temperature (for example up to 50–80° C.), its electrical resistance remains almost unchanged (i.e. it acts as insulation material), but at a certain predetermined temperature it decreases abruptly. Such an abrupt fall of electrical resistance is easily detected by a special control circuit of the electronic controller. It is preferable that the abrupt decrease in electrical resistance of the NTC sensing means occurred, somewhere between 60° C. and 130° C.

The term "insulation means" described in this invention shall mean a layer of non-conductive means, which insulates at least portions of electrically conductive textile in the heater. Such insulation means may be in the form of extruded or jacketed polymer, thermoplastic or textile sheet, sleeve, or strip of nonconductive means. As an example, the insulation means may comprise at least one of the following polymers: polyvinyl chloride (PVC), silicon rubber, polyethylene, polypropylene, polyurethane, nylon, polyester, cross-linked polyethylene and PVC, or other appropriate electrical insulating materials. The insulation means may also be utilized as the NTC sensing means in the same heater, depending on the heating element design and its operation temperature.

The term "heat detection means" described in this invention shall mean at least one of the following materials, which provide temperature sensing in the heater: (a) electrically conductive textile fiber or fabric, (b) metal wire, (c) electrically conductive polymer, or other electrically conductive materials. The heat detection means is usually disposed in close proximity to the heating means and provides temperature sensing by: (a) a change in electrical resistance of the electrically conductive textile fibers, polymers or wires due to a temperature change in the heater (such as PTC sensing means) or (b) transferring electrical signal from another temperature sensing layer (such as an NTC sensing layer).

The heat detection means is always connected to an electronic controller, which varies or terminates electrical power supply to the heater. The heat detection means may be electrically connected to another heat sensing material such as an NTC sensing means. The heat detection means may have NTC or PTC properties, depending on the heating element design. As an example, carbon fibers may be used as NTC sensors and Nickel wire or its alloys may be used as PTC sensors for heat detection means. The heat detection means may be encapsulated by a non-conductive material or it may be free of any insulation.

The term "temperature sensing heating cable" described in this invention shall mean heating cable, which contains at least a heat detection means inside the heating cable. Preferably, the temperature sensing heating cable comprises electrically conductive textile fibers, as heating means, which are separated from the heat detection means by at least one layer of NTC sensing means.

The term "sensing cable" described in this invention shall mean a cable consisting of the heat detection means encapsulated by NTC sensing means.

The term "PTC temperature sensing means" described in this invention shall mean heat detection means which possesses positive temperature coefficient (PTC) properties. It is preferable that the PTC temperature sensing means has a high resistance value and a steady linear increase of resistance upon increase of the ambient temperature.

The term "heating tape" described in this invention shall mean a heater having a form of a flexible tape, where tape means a long narrow, flexible strip of material or fabric. Such tape has a width significantly smaller than its length. The heating tape may be comprised of insulated or non-insulated electrically conductive textile fibers combined with fabric or polymer material. The heating tape may contain weaving yarns, knitted yarns, extruded or molded polymers, knitted, woven or non-woven synthetic or inorganic fibers, threads or textiles.

The term "heating sheet" described in this invention shall mean a heater having a form of a sheet, where sheet means a broad surface of material or fabric. The heating sheet may be comprised of insulated or non-insulated electrically conductive textile fibers combined with fabric or polymer material. Such heating sheet may contain weaving fibers/threads, knitted fibers/threads, extruded or molded polymers, knitted, woven or non-woven synthetic or inorganic filaments, threads or textile.

The term "heating sleeve" described in this invention shall mean a heater having a form of a sleeve or tubular cover of continuous cross section. The heating sleeve may be comprised of insulated or non-insulated electrically conductive textile fibers combined with a fabric or polymer material. The heating sleeve may contain weaving yarns, knitted yarns, extruded or molded polymers, knitted, woven or non-woven synthetic or inorganic fibers, threads or textiles.

The heater described in this invention may comprise one of the following textile threads/fibers, fiber optical filaments, metal wires or their combination:

1. Metal coated threads, containing synthetic polymer, with similar or varying electrical characteristics.
2. Metal coated threads, made of ceramic or fiberglass fibers, with similar or varying electrical characteristics.
3. Carbon/graphite or carbon coated threads, made of ceramic or fiberglass fibers with similar or varying electrical characteristics.
4. Electrically conductive textile fibers with similar or varying electrical characteristics, impregnated with conductive ink.
5. Metal threads made of metal fibers with similar or varying electrical characteristics.
6. Metal wires with similar or varying electrical characteristics.

7. Carbon containing threads or fibers.
8. Threads/wires, as indicated in 1 through 7 above, with the addition of non-conductive polymer synthetic fibers.
9. Threads/fibers, as indicated in 1 through 8 above, with the addition of non-conductive inorganic fibers, including fiberglass,.
10. Threads/fibers, as indicated in 1 through 9 above, with the addition of metal wires or electrically nonconductive fiber optical filaments as temperature sensors.

The combining of the cables with the non-conductive substrate may be achieved by placing the cables between at least two layers of non-conductive material and subsequent thermal fusing/quilting of the sandwich assembly. It is also possible to utilize adhesive to laminate or to sandwich heating cables and optional nonconductive threads/fibers between non-conductive materials.

The preferred embodiment of the invention shown in FIG. 1A consists of a soft and flexible temperature sensing heating cable, comprising electrically conductive textile fibers (1) as heating media. These fibers (1) have a polymer base with melting temperature between 110° C. and 350° C. In the event of overheating of the temperature sensing heating cable, the electrically conductive textile fibers (1) can melt like a fuse, terminating electrical continuity in the heating cable. Such fusing ability of the heating electrically conductive textile fibers (1) provides inherent overheat and fire hazard protection ability to the heating element described in this invention. In general, such melting fuse acts as a continuous Thermal Cut-Off (TCO) device, which protects the system from overheating through the whole length of the heating cable. The heating cable may contain other electrically non-conductive, strength reinforcing and shape holding fibers (5). The electrically conductive textile fibers are encapsulated by one layer of NTC sensing means (2).

The heat detection means (3) shown on FIG. 1A, is electrically connected to the NTC sensing means (2) and to the feedback electronic controller. The outer insulation means (4) hermetically encapsulates the whole heating cable. If required by the heating element design, the heating means may be placed outside of the NTC sensing jacket (2) and heat detection means (3) can be encapsulated by NTC sensing means (2).

The temperature sensing heating cable is connected to an electronic controller, which may be designed to (a) detect a signal of average temperature change in the heater, (b) to detect a signal of local overheating and (b) to vary or terminate a power control output.

Figure 1B:
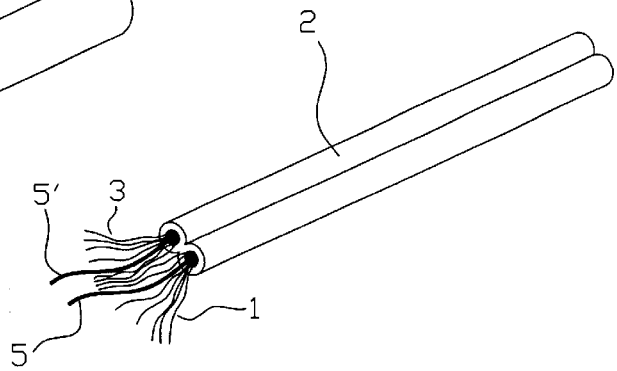
FIG. 1B shows an isometric view of a heating cable consisting of NTC sensing material which encapsulates both: electrically conductive textile fibers and heat detection wires or electrically conductive fibers.

The FIG. 1B demonstrates NTC sensing material (2) encapsulating both heating means (1) and heat detection means (3). Such construction may either have outer insulation means, or it may perform without any insulation, especially, when utilizing low voltage heating systems.

Another variation of the proposed construction may also include a combination of two cables attached to each other: one cable having electrically conductive textile fibers encapsulated by NTC sensing material and the other cable having heat detection means encapsulated by NTC sensing material. It is preferable that these two cables are combined together by insulation jacketing, which secures a continuous electrical connection between the cables.

Figure 2:
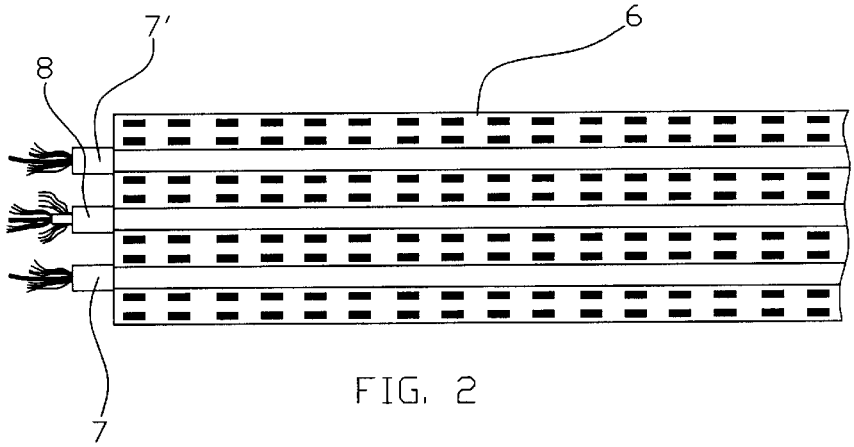
FIG. 2 shows a plan view of a heating tape, consisting of two heating cables and one sensing heating cable.

FIG. 2 describes heating tape (6) including the combination of a temperature sensing heating cable (8) and two non-sensing heating cables (7) and (7'). It is preferable to place the temperature sensing heating cable in the center of the heating tape to provide optimal heat control in the heating element. The cables are separated by nonconductive means to provide constant spacing between the heaters and strength to the heating element.

Figure 3:
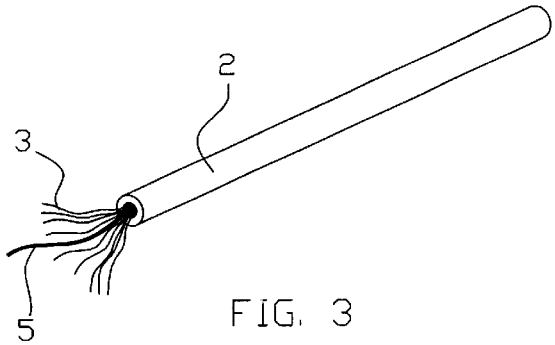
FIG. 3 shows an isometric view of a heat sensing cable, consisting of heat detection wires or electrically conductive fibers encapsulated by NTC sensing material.
Figure 4:
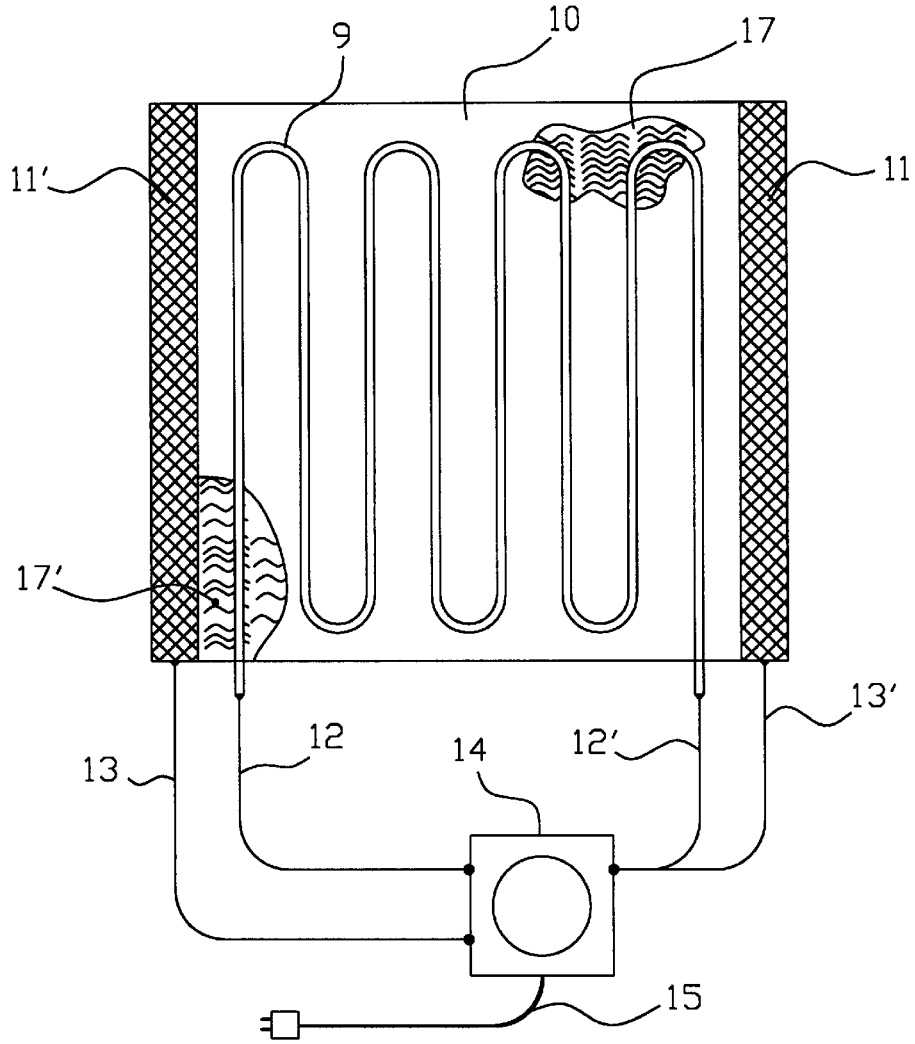
FIG. 4 shows a plan view of a sensing cable placed, in serpentine pattern, on a sheet type heater and connected to a feedback electronic controller.

The FIG. 3 shows a sensing cable made of heat detection means (3) which is reinforced by nonconductive fibers (5) and encapsulated by NTC sensing means (2). Such sensing cable may be applied to various heating element constructions to detect local overheating and to provide precision temperature control. One of the examples of a sensing cable application is shown in FIG. 4, which represents one of the preferred embodiments of this invention: flat panel heater comprising heating sheet (10) as a heating means. The sensing cable (9) is placed in serpentine pattern on the heating sheet to provide maximum uniform coverage of the sensor over the heating body. It is very important to provide good mechanical and electrical connection between the heating sheet (10) and the sensing cable (9). It is preferable to position the sensing cable near the bus conductors (11) and (11') because bad electrical connection between bus conductors and the heating sheet very often causes overheating problems in the field. Both panel heater and sensing cable are connected through lead wires (12, 12', 13 and 13') to a "feedback" electronic controller (14), connected to the electrical power outlet through a cable cord (15).

In the event of local overheating, for example, in a spot (17) and/or spot (17'), the sensing cable will send the signal back to the electronic controller (14), which will terminate electrical continuity in the panel heater, permanently or temporarily, depending on the electronic controller design. The sensing cable may provide maximum temperature level control if the heat detection means inside the sensing cable includes PTC temperature sensing means.

Figure 5:
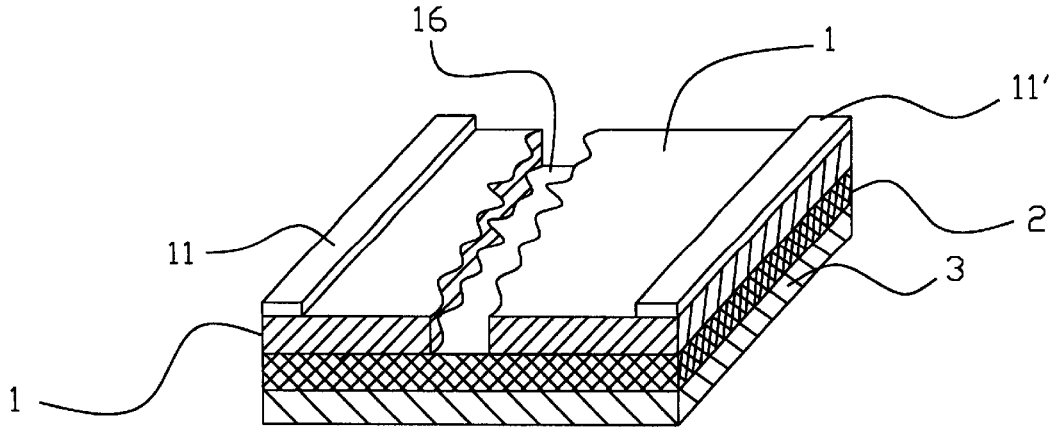
FIG. 5 shows an isometric view of sheet type temperature sensing heater consisting of heating fabric and a heat detection layer separated by a layer of NTC sensing material.

FIG. 5 shows another variation of a sheet type heating panel, made by sandwiching a layer of heating sheet (1), a layer of NTC sensing means (2) and a layer of heat detection means (3). The heating sheet (1) is connected to two bus conductors (11 and 11'). In the event the heat detection means fails to detect overheating in the heating sheet (1) or the electronic control system fails to respond to an overheating signal, the electrically conductive textile fibers will melt in the location of maximum heat concentration (16), terminating electrical continuity in the heating sheet. Thus, thermal fusing ability of the heating means makes the proposed heaters inherently safe products.

Figure 6A:
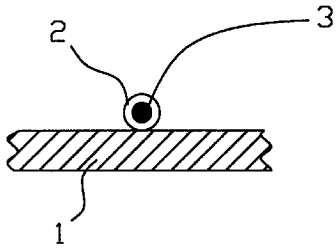
FIG. 6A shows a cross section heating fabric or tape in contact with sensing cable which consists of heat detection wires or electrically conductive fibers encapsulated by NTC sensing material.
Figure 6B:
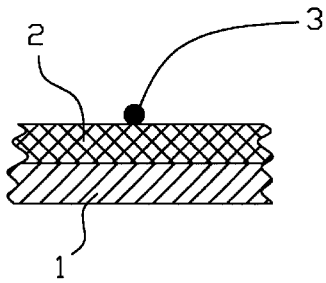
FIG. 6B shows a cross section of heating fabric and heat detection electrically conductive fibers separated by a layer of NTC sensing material.
Figure 6C:
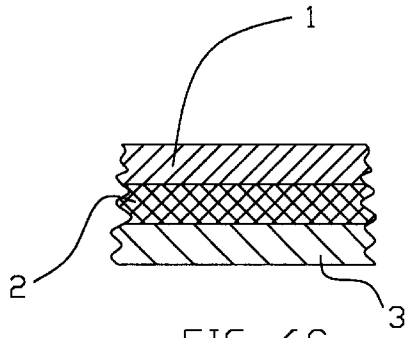
FIG. 6C shows a cross section of heating fabric and heat detecting electrically conductive fabric separated by a layer of NTC sensing material.

FIG. 6(A, B and C) summarize possible variations of temperature sensing heating sheet or heating tape constructions. FIG. 6A shows flat heating means (1) connected to a sensing cable made of NTC sensing layer (2) and heat detection means (3). The FIG. 6B shows a sandwich of flat panels made of heating sheet or heating tape (1) and NTC sensing layer (2). The heat detection means (3) is attached to this sandwich making reliable electrical connection with the NTC sensing layer. FIG. 6C shows a triple layer sandwich made of heating sheet or heating tape (1), NTC sensing layer (2) and heat detection means (3).

Figure 7:
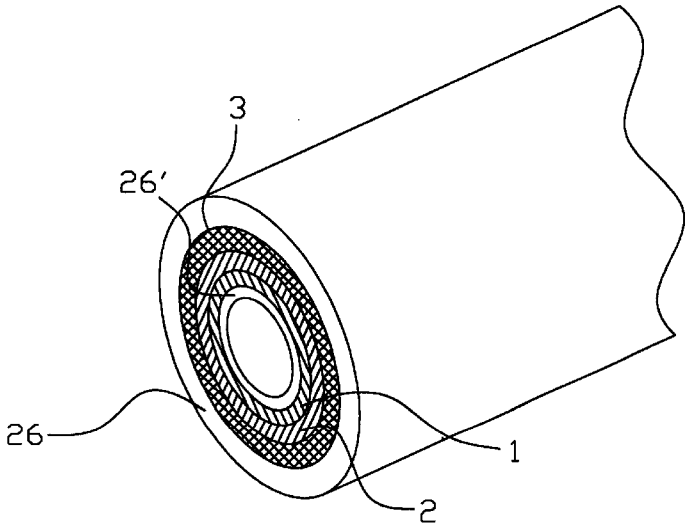
FIG. 7 shows an isometric view of insulated multi-layer heating tubing, consisting of outer insulation, layer of heat detecting electrically conductive fibers, layer of NTC sensing material, heating fabric and inner insulation layer.

FIG. 7 demonstrates a heating sleeve as another preferred embodiment of this invention. The heating sleeve may be without insulations or it may have inner and/or outer insulations. The example shown in FIG. 7 is heating tubing designed to heat moving liquid media. Its construction includes inner and outer insulation means (26 and 26'), heating means (1), NTC sensing layer (2) and heat detection means (3). Such temperature sensitive heating sleeve can be very efficient in heating and controlling of highly viscous and/or coagulating liquids, which have a tendency to create clots inside the piping systems.

Figure 8:
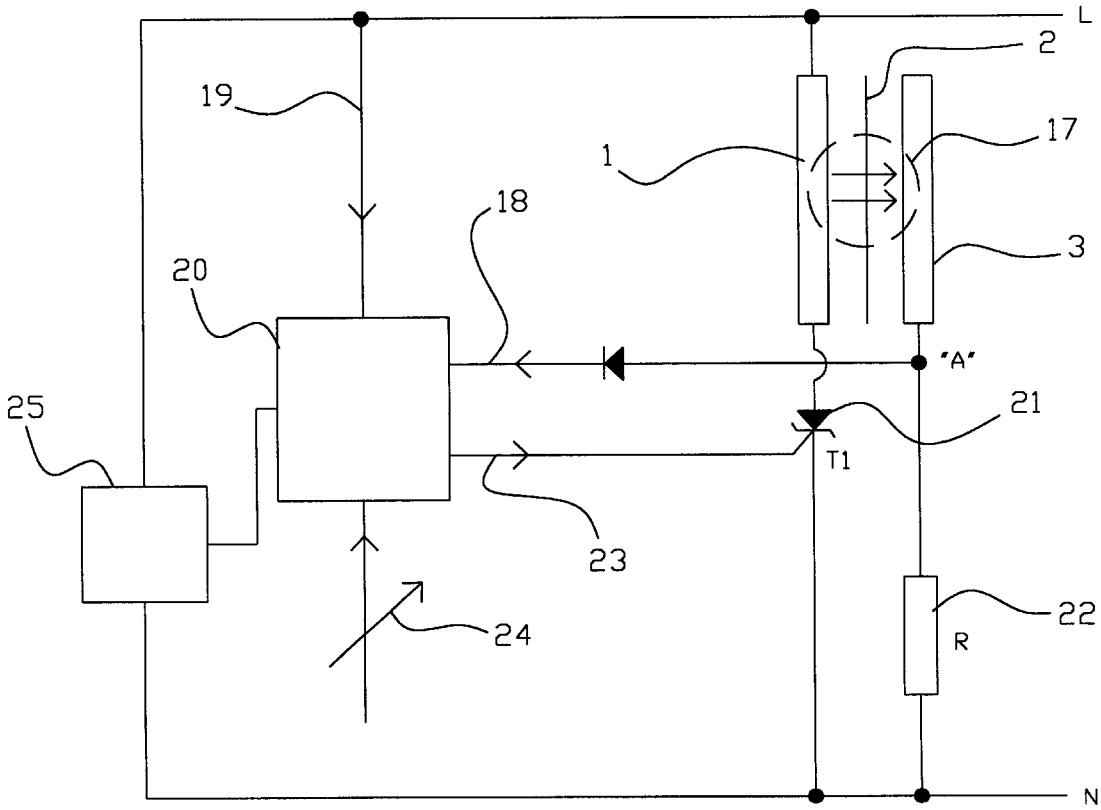
FIG. 8 shows the principal electrical circuit diagram of the NTC sensing control system.

FIG. 8 shows a principal electrical circuit diagram of the NTC sensing and electronic control system. The diagram describes a heating element made of heating means (1) and heat detection means (3), separated by a layer of NTC sensing means (2). The power to the system is supplied by a power supply (25). The power setting regulation is provided by a selectable heat setting device (24). The voltage switching device (21) is used to regulate power to the heating means (1) under the control of Control Logic System (20). The electrical line (19) provides synchronized input of radio frequency interference (RFI) free switching. The line (18) provides input signal to Control Logic System (20) from heat detection means (3). The line (23) provides an output to the heating means (1) from the Control Logic System (20). The item (22) is a potential divider resistor. The described circuit is in common use and it is usual to have multiple heat settings using, for example, the "burst firing" technique.

During normal heating operation (for example at the temperatures from 20° C. to 60° C.), there is extremely low electrical conduction through the NTC sensing layer (2), therefore the voltage at point ("A") is very low, for example less than 1.0 Volt. However, if a hot spot (17) occurs, the electrical resistance of the NTC sensing layer (2) in the vicinity of the hot spot (17) starts to fall abruptly. This causes the voltage to increase at a point ("A") to, for example, a level of 5.0 Volts. Such voltage increase is immediately detected at the input of the Control Logic System (20), which can terminate electrical continuity in the heating means via the voltage switching device (21), preventing overheating and destruction (meltdown) of the heating means (1). However if the described electronics for hot spot detection fails, then the heating means (1) will fuse (melt down) in the vicinity of the hot spot, preventing burns or fire hazard.

The proposed soft temperature sensing heater may be utilized in a variety of commercial and industrial heater applications, utilizing direct or alternating current. The main advantage of these heaters is high reliability provided by inherently fusible and durable electrically conductive textile threads/fibers.

The process of manufacturing the temperature sensing heating cables, heat detection means, NTC sensing means and their assembly in the heating products can be fully automated. Some designs of the heaters may be manufactured in rolls or spools with subsequent cutting to predetermined shapes and sizes.

Further, the proposed heaters can be utilized in, but not limited to: (a) electrically heated blankets, throws, pads, mattresses, pet beds, foot warmers, mats, bedspreads and carpets; (b) electrically heated walls, ceiling and floor electric heaters; sub flooring, office dividers/panels, window blinds, roller shades, mirrors, fan blades and furniture; (c) electrically heated seats, cushions, wall, door and ceiling panels for automotive and recreational vehicles, scooters, motorcycles, boat, aircrafts, trains, trucks, busses and other transportation vehicles; (d) electrically heated safety vests, garments, boots, gloves, hats, jackets, emergency or survival wear, scuba diving suits and other apparels; (e) electrically heated food (Example: pizza) delivery bags or food storage, sleeping bags, towels, boot and glove dryers; (f) refrigerator, road, driveway, walkway, window, roof, gutters and aircraft/helicopter wing/blade deicing systems, (g) pipe line, drum and tank electrical heaters, (h) medical/health care, body/limb warmers, emergency blankets, etc. In addition to various heating applications, the same electrically conductive textile fibers may be simultaneously utilized for anti-static and/or electromagnetic (radio frequency) interference protection, or as a flexible antenna for wireless communication devices.

Further, the use of fusible electrically conductive threads/fibers in various optional heating embodiments has the following advantages:

- it enables manufacturing of thin, flexible and soft heaters,
- it provides high durability of the heaters due to their ability to withstand sharp folding, small perforations, punctures and compression without decreasing of electrical operational capabilities;
- it provides high wear and tear resistance owing to: (a) high strength of the electrically conductive threads/fibers and (b) optional tight enveloping around all electrically conductive media with strong nonconductive means;
- it provides for manufacturing of corrosion and erosion resistant heaters owing to: (a) high chemical inertness of the carbon coated inorganic threads and ceramic yarns, (b) hermetic polymer insulation of the whole heater, heat detection means, terminal connections and temperature control devices, for utilization in chemically aggressive industrial or marine environments;
- it provides for saving of electric power consumption owing to its low temperature density and its ability to be placed closer to the heated surface with less cushioning and insulation, thereby promoting faster warm-up;
- it offers versatility of form, shape and insulating properties and therefore suitability for a wide range of heating applications owing to its compatibility with a diversity of manufacturing techniques and processes including but not limited to weaving, stitching, knitting, extrusion and lamination;
- it allows for manufacturing of heaters in various configurations in parallel or in series;
- it overcomes the problem of overheated spots owing to (a) high heat radiating surface area of the heating means, (b) utilizing of heat detection means and NTC sensing means placed close to the heating means, (c) utilizing of the electrically conductive textile fibers with low melting temperature;
- it provides for extremely low thermal expansion of the heater owing to the nature of the electrically conductive threads, polymer or nonconductive yarns/fibers. This feature is extremely important for construction applications (Example: concrete or steel beams) or for multi-layer insulation with different thermal expansion properties;
- it offers a high degree of flexibility and/or softness of the heater, depending on the type and thickness of insulation; and
- it provides technological simplicity of manufacturing and assembling of said heating elements.

The aforementioned description comprises different embodiments, which should not be construed as limiting the scope of the invention but as merely providing illustrations of some of the presently preferred embodiments of the invention.

While the foregoing invention has been shown and described with reference to a number of preferred embodiments, it will be understood by those possessing skill in the art that various changes and modifications may be made without departing from the spirit and scope of the invention.

What is claimed is:

1. A soft and flexible temperature sensing heater having a durable construction for incorporation into a plurality of articles, said heater comprising:

at least one continuous melting fuse, said melting fuse comprising at least one electrically conductive textile fiber as heating means, said at least one electrically conductive textile fiber melts at the temperature above 110° C. and below 350° C. terminating electrical continuity in said heating means and preventing fire hazard in said temperature sensing heater, at least one electronic controller to vary power output and to control maximum heating level of said temperature sensing heater, at least one heat detection means providing an electrical feedback signal to said electronic controller by detecting a change of temperature in said heating means;

at least one NTC sensing means, placed between, and electrically connected to said heating means and said heat detection means.

2. A soft and flexible temperature sensing heater as defined by claim 1, wherein said heater is a temperature sensing heating cable, comprising said heating means encapsulated by said NTC sensing means.

3. A soft and flexible temperature sensing heater as defined by claim 2, further comprising outer insulation means encapsulating said temperature sensing heating cable, connected to said heat detection means.

4. A soft and flexible temperature sensing heater as defined by claim 1, wherein said heat detection means comprises at least one metal wire.

5. A soft and flexible temperature sensing heater as defined by claim 1, wherein said heat detection means comprises at least one electrically conductive textile fiber.

6. A soft and flexible temperature sensing heater as defined by claim 1 wherein said heat detection means comprises continuous PTC temperature sensing means.

7. A soft and flexible temperature sensing heater as defined by claim 2, wherein both, said heat detection means and said heating means are encapsulated by at least one said NTC sensing means.

8. A soft and flexible temperature sensing heater as defined by claim 3, wherein said at least one temperature sensing heating cable is combined with at least one heating cable to form continuous heating tape.

9. A soft and flexible temperature sensing heater as defined by claim 3, wherein at least two said temperature sensing heating cables are combined with nonconductive means to form continuous heating tape.

10. A soft and flexible temperature sensing heater as defined by claim 1 wherein at least said heating means has a form of a sheet.

11. A soft and flexible temperature sensing heater as defined by claim 10 wherein said heat detection means is encapsulated by said NTC sensing means forming a sensing cable, said sensing cable is placed on, and electrically attached to the surface of said heating means to detect local overheating of said temperature sensing heater.

12. A soft and flexible temperature sensing heater as defined by claim 1 wherein at least said heating means has a form of a sleeve of continuous cross section.

* * * * *